US005193900A

United States Patent [19]

Yano et al.

[11] Patent Number: 5,193,900

[45] Date of Patent: Mar. 16, 1993

[54] ILLUMINATION DEVICE

[75] Inventors: Tadashi Yano; Kenjiro Hashimoto, both of Osaka, Japan

[73] Assignee: Matsushita Electric Industrial Co., Ltd., Osaka, Japan

[21] Appl. No.: 842,321

[22] Filed: Feb. 28, 1992

[30] Foreign Application Priority Data

Mar. 5, 1991 [JP] Japan ..... 3-038309

[51] Int. Cl.[5] ..... F21V 9/00

[52] U.S. Cl. ..... 362/284; 362/2; 362/277; 362/293

[58] Field of Search ..... 362/1, 2, 277, 278, 362/280, 284, 293, 319, 320, 323, 458; 359/885, 888, 889

[56] References Cited

U.S. PATENT DOCUMENTS 3,355,982 12/1967 Rendina ..... 362/2
3,870,873 3/1975 Mallory ..... 362/2
4,423,469 12/1983 Zerlaut et al. ..... 362/2

*Primary Examiner*—Richard R. Cole
*Attorney, Agent, or Firm*—Stevens, Davis, Miller & Mosher

[57] ABSTRACT

Provided is an illumination device in which natural light having a correlated color temperature equivalent to that of artificial light can be obtained so that there is no feeling of physical disorder against the artificial light when the natural light is used in combination with the artificial light for energy saving. In the illumination device, luminous flux of natural light in a visible light range (380 nm–780 nm) is detected by a color temperature sensor in a first light detector portion (8), the correlated color temperature of the natural light is obtained through operation by a first operation portion (9), artificial light is detected by a color temperature sensor in a second light detector portion (10), the correlated color temperature of the artificial light is obtained through operation by a second operation portion (11), and color temperature converting filters are switched by a filter operating portion (14) so that a difference between the correlated color temperature of the natural light and the correlated color temperature of the artificial light obtained through operation by a third operation portion is made equal to or smaller than 5.5 mired to thereby obtain mixed light giving no feeling of physical disorder.

2 Claims, 1 Drawing Sheet

ILLUMINATION DEVICE

BACKGROUND OF THE INVENTION

The present invention relates to an illumination device for producing light color of natural light which gives no feeling of physical disorder against artificial light by using natural light together with artificial light to thereby save energy.

Recently, variety of environmental pollutions have been generated with the development of industries, so that the environmental problems have become regarded as important. Further, the finiteness of resources has been pointed out and the movement of promoting energy saving has become extensive. Recently also with respect to an illumination source, therefore, various devices such as provision of skylights, widening of windows, etc., are employed in buildings under the consideration of using natural light as much as possible in the day time.

However, when only natural light is used, sometimes the light becomes not sufficient depending on location, or in an evening, the quantity of light becomes not insufficient. In such cases, accordingly, illumination is performed by a combination of natural light and artificial light.

Since the light color of natural light in the evening is very reddish, however, the light color of the natural light becomes so different from the light color of artificial light that the balance of light color becomes bad depending on the room, and an influence is given to the characteristics of the human sense of color to make the sense obscure to cause characters which can not be recognized. To cope with this, there has been developed no illumination device for natural light in which the light color of natural light is made to be in accord with that of artificial light while taking the difference in light color between natural light and artificial light into consideration. Accordingly, there has been caused a feeling of physical disorder in a room even if natural light is used or it has been impossible to use natural light sufficiently effectively in the evening.

SUMMARY OF THE INVENTION

The present invention is intended to solve the above problems, and an object of the present invention is to provide an illumination device using natural light, in which natural light is effectively used so that natural light having a correlated color temperature equivalent to that of artificial light is reproduced.

In order to achieve the above object, according to an aspect of the present invention, the illumination device comprises a first correlated color temperature sensor for detecting a correlated color temperature from radiant flux in a visible wavelength range (380 nm–780 nm) of incident natural light, and a second correlated color temperature sensor for detecting a correlated color temperature from radiant flux in a visible wavelength range (380 nm–780 nm) of artificial light, wherein an operation portion for comparing the correlated color temperature of the incident natural light detected by the first correlated color temperature sensor with the correlated color temperature of the artificial light provided in each room and detected by the second correlated color temperature sensor is made to calculate the difference between the correlated color temperature of the incident natural light and the correlated color temperature of the artificial light so that switching of color temperature converting filters is carried out by a control portion on the basis of the result of calculation to make a difference between the correlated color temperature of the natural light and the correlated color temperature of the artificial light to be equal to or smaller than 5.5 mired.

According to the present invention, by the above-mentioned means, it is possible to secure the correlated color temperature of natural light by the provision of the correlated color temperature sensor which successively detects the correlated color temperature of natural light, though the correlated color temperature of natural light largely varies depending on the season, and the date and hour. The color temperature discrimination range is generally known to be 5.5 mired. Accordingly, the color temperature conversion by means of the color temperature converting filter is carried out so as to make the difference between the correlated color temperature of the natural light and the correlated color temperature of the artificial light to be equal to or smaller than 5.5 mired. Thus, it is made possible to secure natural light which gives no feeling of physical disorder against the light color of artificial light.

DESCRIPTION OF THE PREFERRED EMBODIMENT

Figure 1:
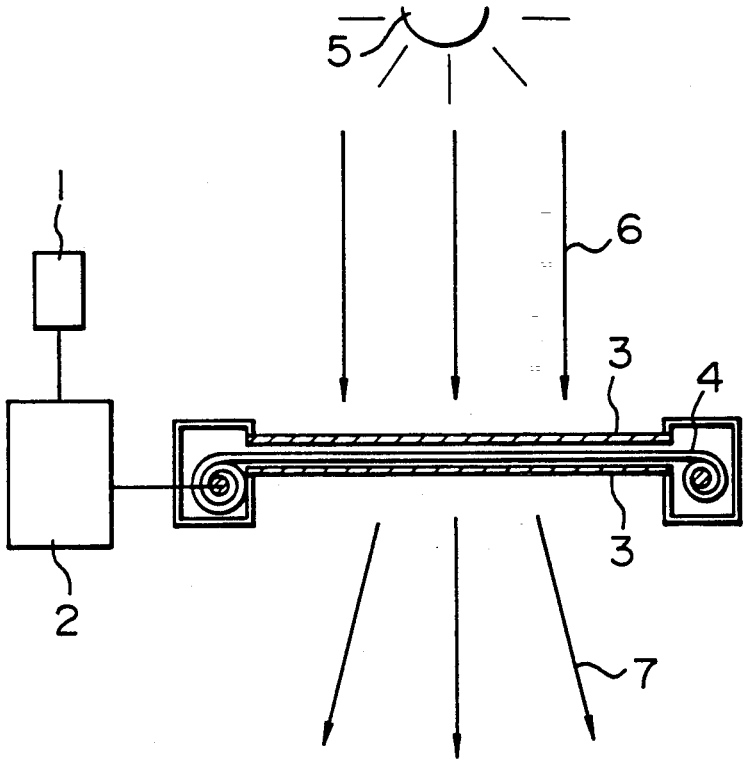
FIG. 1 shows the configuration of a main portion of an embodiment of the illumination device according to the present invention.

Referring to the drawings, an embodiment of the illumination device for natural light according to the present invention will be described hereunder.

It is said that from sunrise to sundown the correlated color temperature of natural light changes in a range from about 2000 K. to about 12,000 K. This corresponds to a range from the correlated color temperature of a low pressure sodium-vapor lamp for use in a tunnel or the like to the correlated color temperature of a light tingled with blue color more than the correlated color temperature of a mercury-vapor lamp for use for street illumination or the like. That is, it is understood that the correlated color temperature of natural light changes over about 10000 K. through one day. On the other hand, the correlated color temperature of artificial illumination light for use in home is in a range of from about 3000 K. to 7000 K. Particularly in Japan, the use of fluorescent lamp is more than incandescent lamps with the ratio of fluorescent lamps to incandescent lamps is 8:2 generally, fluorescent lamps having a correlated color temperature of about 5000 K. are widely used in houses. Accordingly, in the case of using natural light for use for in-home illumination or in-office illumination, a difference between the correlated color temperature of natural light and the correlated color temperature of artificial light has given a feeling of physical disorder, has made the illumination disagree with the atmosphere of the room, or has given an influence to color distinguishability. For example, with respect to the spectral distribution of an illumination light source having a correlated color temperature of about 3000 K., the radiant flux ratio in a short wave-length range is smaller than that in a long wave-length range, and therefore the distinguishability for a group of blue is inferior to that for a group of red depending on illuminance level.

Accordingly, it is necessary to convert the correlated color temperature of natural light into the correlated color temperature of artificial light before the natural light is incident into the inside of a room from the outside thereof.

That is, it is necessary to provide an illumination device for natural light which comprises a sensor for detecting the correlated color temperature of natural light, a computer for operating and controlling data of the correlated color temperature detected by the sensor and data of the correlated color temperature of artificial light, and a color temperature converting filter for converting the correlated color temperature of natural light into the correlated color temperature of artificial light.

FIG. 1 shows the configuration of a main portion of an embodiment of the illumination device according to the present invention. In FIG. 1, The reference numeral 1 designates a color temperature detecting sensor; 2 a microcomputer; 3 a plate glass; 4 various color temperature converting filters continuously taken up on a shaft; 5 a natural light source; 6 incident natural light; and 7 color-temperature-converted natural light. The color temperature detecting sensor 1 detects luminous flux of the incident natural light 6 in a visible light range (380~780 nm) so as to perform operation on the incident natural light 6 to thereby produce an output signal representing the correlated color temperature of the incident natural light 6. The microcomputer 2 is supplied with the output signal from the color temperature detecting sensor 1, and selects a suitable one of the color temperature converting filters 4 through operation so that a difference between the correlated color temperature of the color-temperature converted natural light 7 and the correlated color temperature of artificial light is made equal to or smaller than 5.5 mired on the basis of the relation with the stored correlated color temperature of in-room artificial light. The correlated color temperature of the natural light 7 subjected to color temperature conversion by means of the selected color temperature converting filter 4 becomes equal to the correlated color temperature of the artificial light. In such a configuration, it is possible to provide an effective means in which natural light is used so as to realize natural light having a correlated color temperature equivalent to that of artificial light and giving no feeling of physical disorder against the artificial light.

Figure 2:
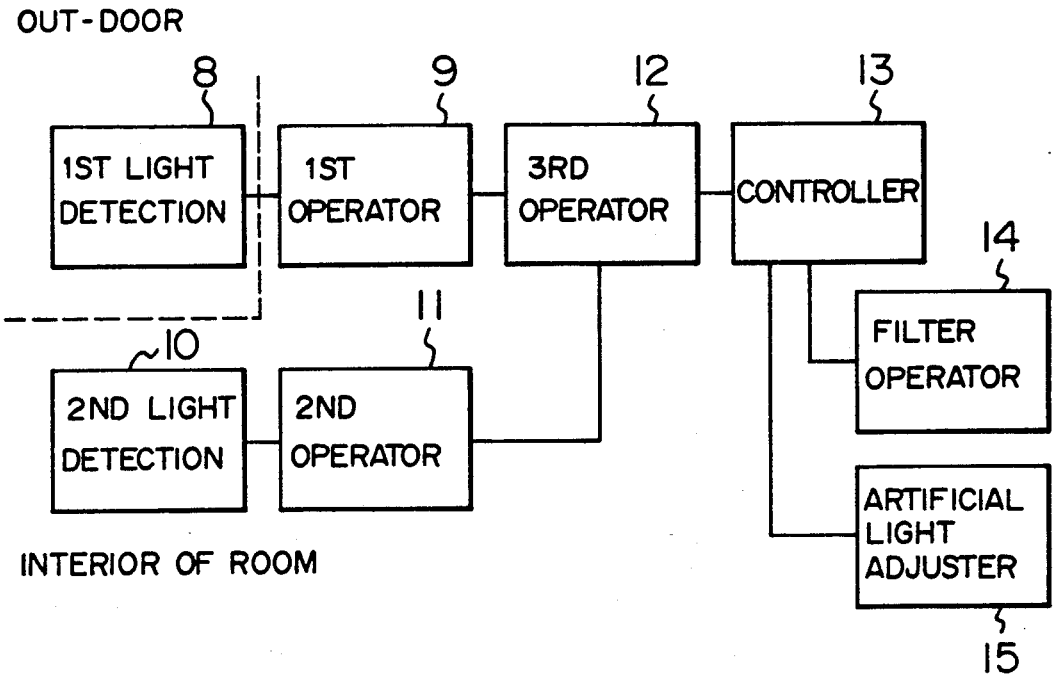
FIG. 2 is a block diagram of the system of the illumination device according to the present invention.

FIG. 2 is a block diagram of the system configuration of an embodiment of the illumination device using natural light according to the present invention. In the drawing, the reference numeral 8 designates a first light detector portion; 9 a first operation portion; 10 a second light detector portion; 11 a second operation portion; 12 a third light operation portion; 13 a control portion; 14 a filter operating portion; and 15 an artificial light adjustment portion. The first light detector portion 8 is provide outdoors to successively detect the luminous flux of the incident natural light 6 in a visible light range (380~780 nm) to thereby produce an output signal. The first operation portion 9 receives and operates the signal from the first light detector portion 8 to calculate the correlated color temperature of the incident natural light 6, and supplies an output signal to the third operation portion 12. On the other hand, the second light detector portion 10 is provide in the interior of the room to successively detect the luminous flux of the artificial light in a visible light range (380~780 nm) to thereby produce an output signal. The second operation portion 11 receives and operates the output signal from the second light detector portion 10 to calculate the correlated color temperature of the artificial light, and supplies an output signal to the third operation portion 12. The third operation portion 12 receives and operates the respective output signals from the first and second operation portions; performs operation so as to select one of the color temperature converting filters to make the color-temperature-converted natural light 7 equivalent to the correlated color temperature of the artificial light within an error of 5.5 mired; performs operation on the output signal from the second operation portion 11 so that the illuminance level of the room becomes a value recommended by JIS (Japanese Industrial Standards) stored in advance; and supplies the control portion 14 with a signal representing the number of the color temperature converting filter 4 for converting the correlated color temperature of the natural light and a signal representing the illuminance value necessary to secure the illuminance level. The control portion 13 receives the signals supplied from the third operation portion 12, converts those signals into control signals, and outputs the control signals. The filter operating portion 14 the signal outputted from the control portion 13 for controlling the color temperature converting filters 4 so as to operate to select a suitable one of the various filters continuously taken up on the shaft to thereby make the color-temperature-converted natural light 7 equivalent to the correlated color temperature of the artificial light.

The artificial light adjustment portion 15 converts the control signal outputted from the control portion 13 for making the illuminance level be an illuminance value to fix the illuminance level into a control signal necessary for performing artificial light adjustment to thereby perform the artificial light adjustment.

By providing such an illumination device for natural light at any opening portion of a dwelling such as a skylight, a window, etc., it is possible to construct a visual environment which effectively uses natural light to thereby realize natural light which gives no feeling of physical disorder against artificial light and which has a correlated color temperature equivalent to the correlated color temperature of the artificial light.

As apparent from the forgoing embodiments, according to the present invention, it is possible to provide an illumination device using natural light, which effectively uses the natural light to thereby realize natural light which gives no feeling of physical disorder against artificial light and which has a correlated color temperature equivalent to the correlated color temperature of the artificial light so that energy saving can be achieved.

We claim:

1. An illumination device comprising:

a first light detector portion having a correlated color temperature sensor for detecting a correlated color temperature from radiant flux in a visible wave-length range (380 nm–780 nm) of incident natural light;

a second light detector portion having a correlated color temperature sensor for detecting a correlated color temperature from radiant flux in a visible wave-length range (380 nm–780 nm) of artificial light;

an operation portion for comparing the correlated color temperature of said incident natural light detected by said correlated color temperature sensor of said first light detector portion with the correlated color temperature of said artificial light provided in each room and detected by said correlated color temperature sensor of said second light detector portion;

a control portion for controlling color temperature converting filter switching on the basis of a result of operation of said operation portion so that a difference between the correlated color temperature of the natural light subjected to color temperature conversion and the correlated color temperature of the artificial light is made equal to or smaller than 5.5 mired;

color temperature converting filters for converting the correlated color temperature of the natural light so that the difference between the correlated color temperature of the natural light subjected to color temperature conversion and the correlated color temperature of the artificial light is made equal to or smaller than 5.5 mired; and a filter operating portion for carrying out the switching of said color temperature converting filters.

2. An illumination device according to claim 1, further comprising an artificial light adjustment portion for fixing an illuminance level in a room.

* * * * *